US009394725B2

(12) United States Patent
Zabala Zabaleta

(10) Patent No.: US 9,394,725 B2
(45) Date of Patent: Jul. 19, 2016

(54) ELECTRONIC LOCK WITH RADIO FREQUENCY IDENTIFICATION FOR METAL DOORS

(71) Applicant: Ojmar, S.A., Elgoibar (Gipuzkoa) (ES)

(72) Inventor: Jon Zabala Zabaleta, Elgoibar (ES)

(73) Assignee: OJMAR, S.A., Elgoibar (Gipuzkoa) (ES)

( * ) Notice: Subject to any disclaimer, the term of this patent is extended or adjusted under 35 U.S.C. 154(b) by 0 days.

(21) Appl. No.: 14/746,264

(22) Filed: Jun. 22, 2015

(65) Prior Publication Data

US 2016/0076274 A1 Mar. 17, 2016

(30) Foreign Application Priority Data

Sep. 12, 2014 (ES) ..... 201431316

(51) Int. Cl.

| | |
|---|---|
| ***E05B 47/00*** | (2006.01) |
| ***H01Q 13/00*** | (2006.01) |
| ***H01H 35/00*** | (2006.01) |
| ***G07C 9/00*** | (2006.01) |
| ***H01Q 13/10*** | (2006.01) |

(52) U.S. Cl.

CPC ..... *E05B 47/0001* (2013.01); *G07C 9/00944* (2013.01); *H01Q 13/10* (2013.01); *E05B 2047/0048* (2013.01); *E05B 2047/0072* (2013.01)

(58) Field of Classification Search

CPC ..... E05B 47/00; E05B 41/00; H01Q 13/10

USPC ..... 340/5.1, 5.73, 10.1; 70/432, 461

See application file for complete search history.

(56) References Cited

U.S. PATENT DOCUMENTS

| | | | | |
|---|---|---|---|---|
| 3,971,581 | A * | 7/1976 | Montgomery | E05C 19/166 292/251.5 |
| 4,845,471 | A * | 7/1989 | Chu | E04B 45/06 200/61.64 |
| 5,204,672 | A * | 4/1993 | Brooks | B60R 25/1003 340/12.22 |
| 5,970,227 | A * | 10/1999 | Dayan | G06F 21/88 340/5.3 |
| 6,307,517 | B1 * | 10/2001 | Lee | G06K 7/0008 340/10.1 |
| 6,308,644 | B1 * | 10/2001 | Diaz | E05G 5/003 109/6 |
| 6,577,226 | B1 * | 6/2003 | Steiner | E05B 81/78 340/10.34 |
| 6,655,180 | B2 * | 12/2003 | Gokcebay | E05B 41/00 340/5.2 |
| 6,745,603 | B1 * | 6/2004 | Shaw | E05B 9/08 70/277 |
| 8,643,468 | B1 * | 2/2014 | Peabody | G07C 9/00944 340/10.1 |
| 2010/0188509 | A1 * | 7/2010 | Huh | G07C 9/00912 348/156 |
| 2013/0227885 | A1 * | 9/2013 | Dawber | E05F 15/2076 49/25 |

* cited by examiner

*Primary Examiner* — Nam V Nguyen

(74) *Attorney, Agent, or Firm* — Lucas & Mercanti, LLP

(57) ABSTRACT

Electronic lock with radiofrequency identification, for metal doors; of the type that consist of electronic means with a chip (C2) and an antenna (a2) that control means (3) that allow/do not allow the movement of a knob/button (4) of the lock for its opening/closing; and of the type that use a card or similar (for example, a wrist band or a key ring) (1) for opening/closing that consists of electronic means with a chip (C1) and an antenna (a1). It places concentrically to the knob/button (4) a plate-antenna (8) that is structured in a first sheet (81) supporting a passive amplifier antenna and a second sheet (82) supporting a ferrite that acts as an anti-interferences filter. It may have a non-metallic shield (9) that set into the metal walls (7) where the lock is located, contains inside it the aforementioned plate-antenna (8).

2 Claims, 4 Drawing Sheets

ELECTRONIC LOCK WITH RADIO FREQUENCY IDENTIFICATION FOR METAL DOORS

CROSS REFERENCE TO RELATED APPLICATION

This Application claims the priority of Spanish Patent Application No. P201431316 filed on Sep. 12, 2014, which is incorporated by reference herein.

OBJECT OF THE INVENTION

The object of the invention refers to an electronic lock with radio frequency identification for metal doors.

BACKGROUND OF THE INVENTION

In the current state of the art locks for metal lockers, metal cabinets, metal doors or for structures that are metallic in at least the area of the lock are already known; said locks consisting of electronic means that are controlled by using an open/close card which, for this purpose, incorporates electronic means in correspondence.

An unresolved problem in these types of locks that base their operation on a set of antennas, lies in the interferences produced when they are placed in metal doors or doors that are metallic in at least the area of the lock. In these cases, the metal structure of the door causes interferences that hamper/impede the correct operation of the lock.

In the current state of the art, and when due to any circumstance, it is not possible to substitute the door, the problem is solved partially by eliminating the metal parts around the lock (for example, making a disproportionately large hole and covering it with a sticker, to maintain the aesthetic appearance of the door) but this type of solution involves additional work and makes it easier to tamper with the lock, decreasing the security of the closure.

DESCRIPTION OF THE INVENTION

The electronic lock with radiofrequency identification for metal doors that is the object of the invention solves this problem without weakening the area around the lock and without additional work on the support structure of the lock. The lock of the invention is of the type that uses an open/close card or similar (for example, a wristband or a key-ring) that consists of electronic means with a first chip and a first antenna and consists of electronic means with a second chip and a second antenna that control the means that allow/do not allow the movement or the blocking of a knob/button of the lock for its opening/closing; it is characterized in that it has concentrically to the knob/button a plate-antenna that is structured in a first sheet supporting a passive amplifier antenna and a second sheet supporting an anti-interferences ferrite.

This plate-antenna equipped with the aforementioned second sheet supporting a ferrite acts as an anti-interference filter, overriding the interferences that are generated by the metal door where the lock is installed, as ferrite is a material commonly used in numerous applications that require the minimization of electromagnetic interferences.

Starting from this basic concept, any embodiments that do not essentially alter, change or modify the proposal are included in the object of the invention. For example, having a non-metallic shield, which, set into the metal walls of the metal door where the lock is installed, contains inside it the aforementioned plate-antenna that contains the ferrite.

Other configurations and advantages of the invention can be deduced from the following description, and from the dependent claims.

DESCRIPTION OF THE DRAWINGS

To understand the object of the invention better, represented in the attached figures is a preferential form of embodiment, subject to accessory changes that do not essentially alter it. In this case.

DESCRIPTION OF A PREFERENTIAL EMBODIMENT

Figure 1:
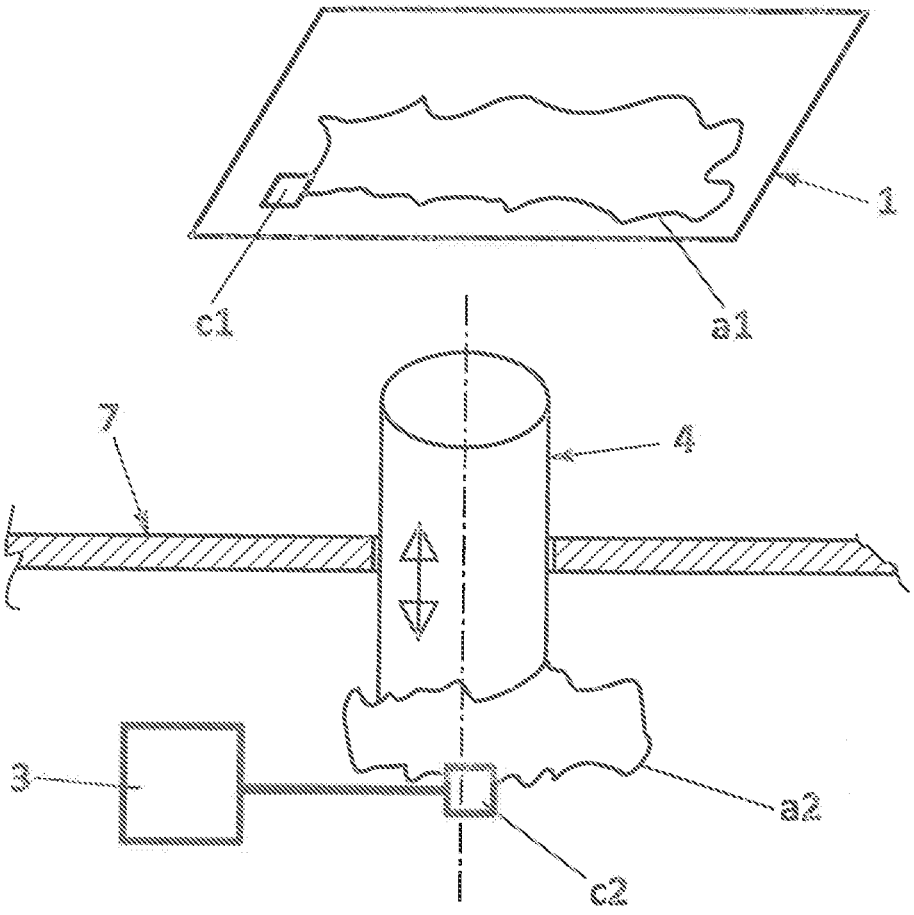
FIG. 1 represents a general scheme of the components of a lock, and its associated open/close card (1), arranged on a metal door (7) according to a known solution.
Figure 2:
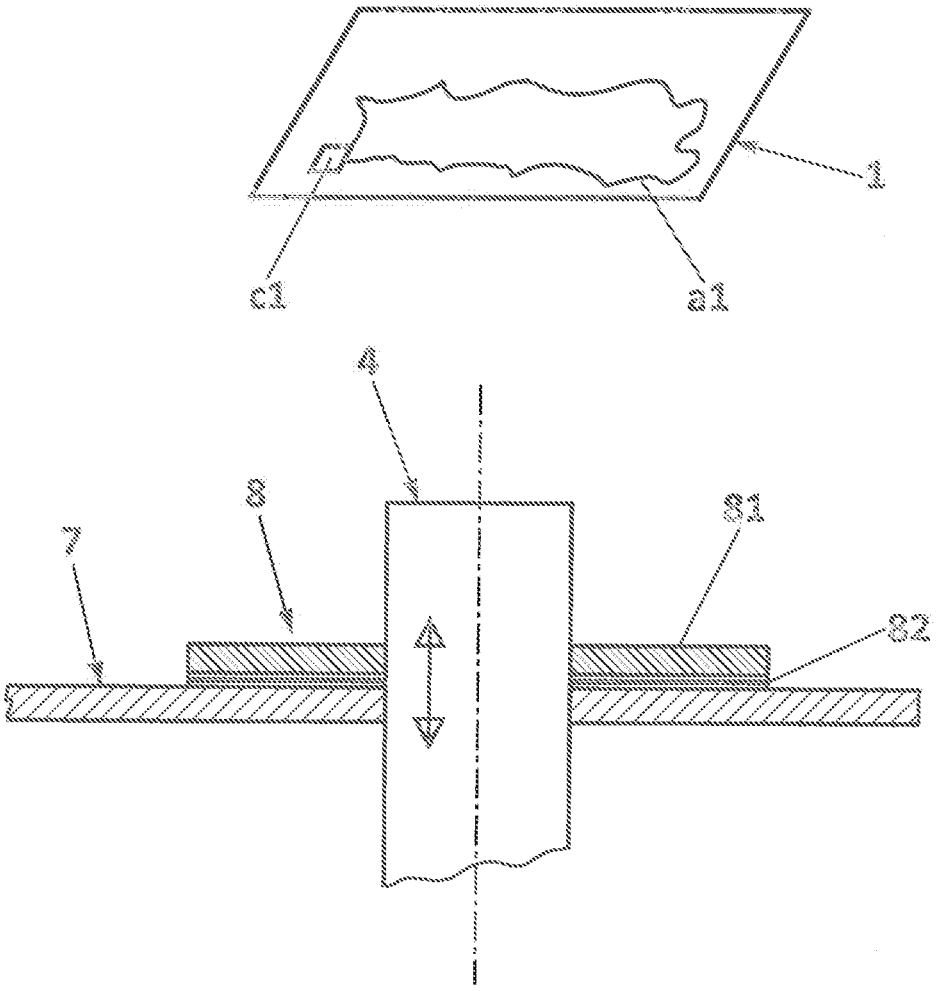
FIG. 2 represents a general cross-sectional scheme of the components of a lock, and its associated open/close card (1), arranged on a metal door (7) according to the invention.
Figure 3:
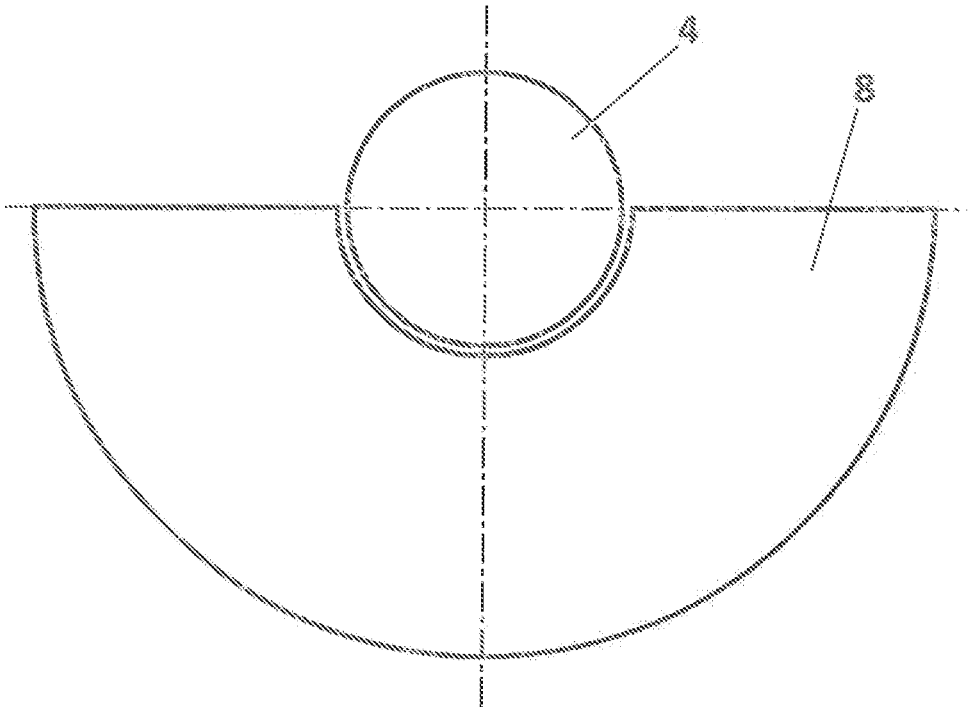
FIG. 3 represents a partial scheme in plan, corresponding to FIG. 2.

Described below is an example of practical, non-limiting embodiment of this invention. Other modes of embodiment in which accessory changes have been introduced that do not essentially alter it are not ruled out.

The object of the invention is an electronic lock with radio frequency identification for metal doors.

In a known configuration, this type of lock uses a card or similar (for example, a wrist band or key ring) (1) for opening/closing, equipped with electronic means with a chip (C1) and an antenna (a1)) and consist of electronic means with a chip (C2) and an antenna (a2) that control the means (3) that allow/do not allow movement or the blocking of a knob/button (4) of the lock for its opening/closing on being activated by a correct card (1).

In conformity with the invention, a plate-antenna (8) is placed concentrically to a knob/button (4) that is structured in a first sheet (81) supporting an amplifier antenna and a second sheet (82) supporting a ferrite that acts as an anti-interferences filter.

The ferrite placed on the second sheet (82) is a material commonly used in numerous applications that require minimization of electromagnetic interferences.

The passive amplifier antenna placed on the sheet (81) is positioned in front of the metal door (7) in such a manner that when it is approached by the correct card (1), this amplifier antenna captures its signal and transmits it to activate the means (3), minimizing the electromagnetic interferences by the action of the ferrite placed on the second sheet (82).

Figure 4:
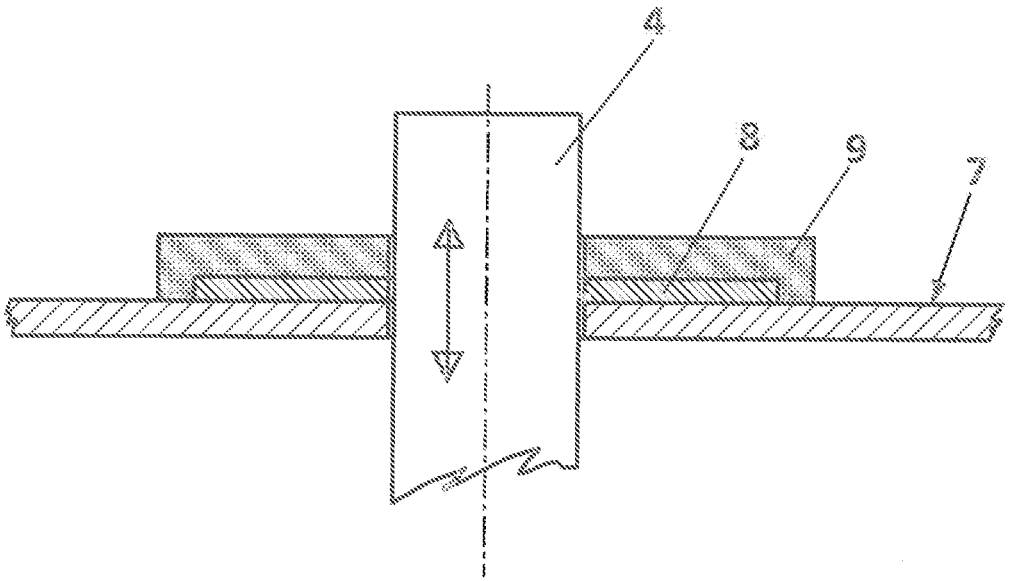
FIG. 4 represents a general cross-sectional scheme according to the invention, similar to FIG. 2, for an alternative configuration that includes a non-metallic shield (9).

In addition, and according to the invention, a non-metallic shield (9) can be set into the metal walls (7) where the lock is located so that this non-metallic shield (9) covers the plate-antenna (8); thus, only the non-metallic shield (9) remains in view on the exterior. See FIG. 4.

The materials, dimensions, proportions and, in general, those other accessory or secondary details that do not essentially alter, change or modify the proposal can be variable.

The terms in which this report is written are a true reflection of the object described; they must be taken in their broadest sense, and never in a limiting manner.

The invention claimed is:

1. An electronic lock system for metal doors comprising:

a metal door;

a knob disposed on the metal door;

a first sheet attached to the metal door, the first sheet comprising a ferrite, the first sheet comprising one of a circular shape and a semicircular shape, wherein the first sheet and the knob are concentric;

a second sheet comprising a passive amplifier antenna, the second sheet being attached to the first sheet, the second sheet comprising one of a circular shape and a semicircular shape, wherein the second sheet and the knob are concentric;

a mechanism comprising a first chip and a second antenna, the mechanism being adapted to control a movement of the knob;

a card comprising a second chip and a third antenna adapted to transmit a signal;

wherein the passive amplifier antenna is further adapted to amplify the signal transmitted by the third antenna and transmit the amplified signal to the mechanism.

2. The electronic lock system for metal doors according to claim 1, further comprising:

a non-metallic shield attached to the metal door and adapted to cover the first sheet and the second sheet;

wherein the first sheet and the second sheet are disposed between the metal door and the non-metallic shield.

* * * * *